US006767523B2

(12) United States Patent
Nixdorf

(10) Patent No.: US 6,767,523 B2
(45) Date of Patent: Jul. 27, 2004

(54) WHISKER-FREE SILICON CARBIDE FIBERS

(75) Inventor: Richard D. Nixdorf, Knoxville, TN (US)

(73) Assignee: Industrial Ceramic Solutions, LLC, Oak Ridge, TN (US)

( * ) Notice: Subject to any disclaimer, the term of this patent is extended or adjusted under 35 U.S.C. 154(b) by 199 days.

(21) Appl. No.: 10/196,033

(22) Filed: Jul. 16, 2002

(65) Prior Publication Data

US 2003/0017096 A1 Jan. 23, 2003

Related U.S. Application Data

(60) Provisional application No. 60/306,217, filed on Jul. 18, 2001.

(51) Int. Cl.[7] ..... C01B 31/36

(52) U.S. Cl. ..... 423/345; 423/346; 501/88; 501/95.1

(58) Field of Search ..... 423/345, 346; 501/887, 95.1

(56) References Cited

U.S. PATENT DOCUMENTS 4,492,681 A * 1/1985 Endou et al. ..... 423/345
4,663,105 A 5/1987 Sakai et al.
4,719,095 A 1/1988 Abe et al.
4,832,929 A 5/1989 Saiki et al.
4,873,069 A 10/1989 Weaver et al.
4,914,070 A 4/1990 Ledoux et al.
4,963,286 A 10/1990 Coyle et al.
5,087,272 A 2/1992 Nixdorf
5,221,526 A 6/1993 Qi et al.
5,383,421 A * 1/1995 Dunmead et al. ..... 117/4
5,618,510 A 4/1997 Okada et al.
5,676,918 A 10/1997 Okada et al.
5,720,933 A 2/1998 Srinivasan
6,689,191 B2 * 2/2004 Dunmead et al. ..... 75/336
2004/0009112 A1 * 1/2004 Angier et al. ..... 423/345

* cited by examiner

*Primary Examiner*—Ngoc-Yen Nguyen
(74) *Attorney, Agent, or Firm*—Pitts & Brittian, P.C.

(57) ABSTRACT

Method for producing discontinuous silicon carbide fibers, useful as heating elements in a low-energy microwave field, from discontinuous carbonized cotton fibers employing an admixture of carbonized cotton fibers, a metal salt promoter, calcium oxalate monohydrate, and low-density silicon dioxide. The admixture, in a dry state, is introduced into a preheated oven at about 1450 to 1750 degrees C. for between about one and five hours. Silicon carbide fibers and a sheet formed from the fibers are disclosed.

11 Claims, 1 Drawing Sheet

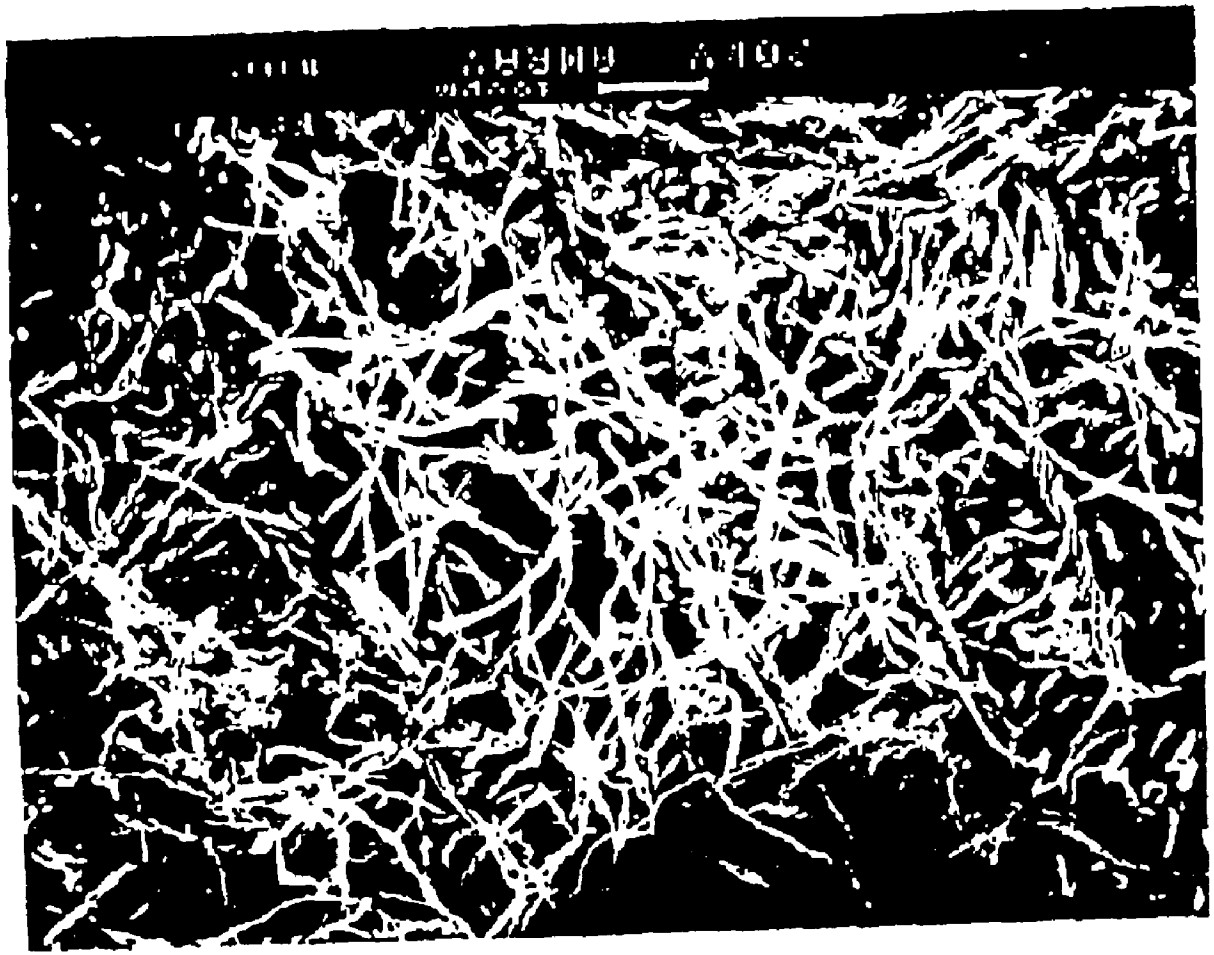
FIGURE

WHISKER-FREE SILICON CARBIDE FIBERS

RELATED APPLICATION

This application is a Non-provisional application based on Provisional application S. No. 60/306,217, filed Jul. 18, 2001, and on which priority is claimed.

FIELD OF INVENTION

This invention relates to silicon carbide discontinuous fibers, which are substantially free of whiskers, and methods for their manufacture.

BACKGROUND OF INVENTION

Silicon carbide whiskers are known in the art. Articles manufactured employing such whiskers are also known to be good to excellent absorbers of microwave energy, particularly low energy microwave energy, e.g., about 2.45 GHz and about 1000–3000 watts. These whiskers are commonly 1–3 microns in diameter and 10–200 microns long.

Silicon carbide whiskers, however, suffer problems relating to their potential carcinogenicity. More specifically, these whiskers, which are very small, readily inhaled, difficult to contain against dispersion into the ambient environment, among other undesirable characteristics or properties, are both difficult and expensive to manufacture and/or to be formed into a product which is useful. One proposed specific use for silicon carbide whiskers is in the fabrication of a filter for carbonaceous or organic components of a gaseous discharge stream, such as, for example, a filter for the exhaust system of a diesel engine.

Due to their small size, e.g., many times smaller than cellulose paper-making fibers which commonly are of about 7–20 microns diameter and about 50–1000 microns length, these whiskers also are unsuitable for use in the well-known and relatively inexpensive paper-making processes for forming the whiskers into a sheet, which can subsequently be formed into a pleated filter paper product, for example.

Heretofore, it has been proposed to produce silicon carbide fibers, as opposed to whiskers, to serve as heating elements in a microwave field. However, certain of these methods produce spun continuous filaments which must be cut to produce discontinuous fibers. This method is expensive and time-consuming. Moreover, cutting of the filaments tends to expose their cut ends to oxidation or other deleterious degradation. Also, it has been proposed to produce silicon carbide fibers which are somewhat free of whiskers, but the method employed requires an initial step of producing carbon fibers which are thereafter converted to silicon carbide. However, these fibers do not heat rapidly in a low energy (e.g., 2.45 MHz) microwave field. None of these known methods provides a cost-efficient and environmentally friendly means for the manufacture of substantially whisker-free silicon carbide fibers which are individually on the order of the size not materially less that the size of cellulose paper-making fibers, hence suitable for use in the manufacture of desired geometrical shapes.

SUMMARY OF INVENTION

The present invention comprises silicon carbide fibers of an individual size equal to or not substantially less than the size of cellulose paper-making fibers and which are substantially free of whiskers. On one embodiment, the fibers are formed employing cotton fibers, preferably chopped cotton fibers. The chopped cotton fibers are carbonized in an inert atmosphere at a temperature of between about 700° C. and about 1200° C. These fibers, in water, are blended with calcium oxalate monohydrate mixed in hot methanol, ferrous sulfate, and fumed silica, and thereafter dried with heating. This mix is loaded into graphite tubes and heated at an elevated temperature for a time sufficient to effect the principal reaction of:

$$SiO^2+3C=SiC+2CO \qquad \text{Eq.1}$$

and resultant conversion of the fibers of the mix to silicon carbide. The process yields about 25% by weight of the original weight of carbonized cotton fibers. The vast majority of the discontinuous silicon carbide fibers are of a size approximating the size of cellulose paper-making fibers. Other components of the process product include smaller silicon fibers and/or particulates of non-fibrous geometry. This product is readily suspended in a slurry which is suitable as one of the feed materials for a slurry employed in a substantially conventional papermaking process, employing conventional and well-known paper-making equipment. In the slurry there may be included other ceramic fibers or additives, for example, as desired. The product obtained employing the paper-making process and equipment comprises a self-supporting sheet of discontinuous silicon carbide fibers which are intertangled in the manner of cellulosic fibers and additives found in a conventional paper product. The sheet product so produced has been found to be foldable, such as pleated on a pleating machine, to form a filter medium comprising principally silicon carbide fibers and, in certain circumstances, lesser quantities of entrapped silicon carbide particulates of non-fibrous geometry.

Importantly, the silicon carbide fibers of the present paper-like product obtained is strongly susceptible to relatively low-energy microwave energy and thus may be heated to a temperature of about 800 degrees C. in less than about 15 seconds. At such temperature, common organic materials entrapped in a silicon carbide fiber filter, for example, are combusted and converted to environmentally friendly products.

BRIEF DESCRIPTION OF DRAWING

The single FIGURE is a photographic representation of silicon carbide fibers admixed with silicon carbide non-fibrous particulates as produced by the process of the present invention.

DETAILED DESCRIPTION OF INVENTION

In accordance with a preferred embodiment of the present invention, a quantity of cleaned, bleached and fully carbonized, cotton fibers, of about 10 microns in diameter, chopped to lengths approximating the length of, or longer than, cellulosic paper-making fibers, e.g., to between about 0.1 and about 4 millimeters in length are admixed, preferably in typical liquid-solids V-blender, equipped with an intensifier and a liquidus bar, with ferrous sulfate suspended in water, calcium oxalate monohydrate suspended in hot methanol or hot water, and low density (e.g., fumed) silica, until homogenized. The homogeneous mixture is dried, preferably at about 300 degrees F. This dry mix is loaded into suitable closed containers, such as semi-porous graphite tubes, which, in turn are loaded into a furnace which preferably is preheated to at least about 1450 degrees C., i.e. below about 1750 degrees C. where the formation of whiskers and particulate silicon carbide forms, for about one hour. The silicon carbide fibers formed within the tubes is recovered for further processing. Such further processing, in accordance with one embodiment, comprises formation of silicon carbide fibrous sheet material, employing convention cellulosic paper-making processes and equipment. The silicon paper-like product may be formed into any of various geometrical shapes, including pleating and incorporation into a regeneratable filter for carbonaceous products contained in a gas stream.

Carbonized cotton fibers, as opposed to carbonized PAN fibers or other organic carbonized fibers, is an important aspect of the present invention. For reasons not known with certainty, all non-cotton carbonized fibers known and available to the present inventor fail to yield the desired silicon carbide fibers, as opposed to whiskers. As noted, the useful cotton fibers should be cleaned and bleached cotton fibers which have been carbonized. Examples of suitable carbonized cotton fibers are those available from E & L Enterprises, Inc. of Oakdale, Tenn., or Aerospace Enterprise, Inc. of Gardner, Me. and identified as AEI 1000 degree C. carbonized cotton fibers. Raw, non-carbonized cotton fibers have been found to exhibit unacceptable mixing characteristics in the present invention even when added to the mix in relatively smaller proportions of a mixture of carbonized and raw cotton fibers.

For use in the present invention, the cotton fibers are chopped following their carbonization to individual fiber lengths of between about one-eighth to about one-half inch. The silicon carbide fibers produced from these cotton fibers retain the morphology of the carbonized cotton fibers. As noted, however, a small percentage of the carbonized cotton fibers end up as short silicon carbide fibers or particulates of silicon carbide. These particulates, however, are of insubstantial significance in the present invention in that, in a papermaking process, such particulates pass through the screen and/or are captured within the formed sheet where they can serve the beneficial function of enhancing the formation of the sheet material.

In the present process, a quantity of the carbonized chopped cotton fibers and water are loaded into a conventional rotary blender or V-blender which preferably is provided with an intensifier and liquidus bar. One suitable blender is a Littleford Model FM-130 rotary blender having a 3 cubic foot capacity. Using this blender, preferably only one-half this capacity is employed. Blending commonly takes place within one to five minutes, using the intensifier. V-blender of the common laboratory type are also acceptable.

To the mix of cotton fibers and water, there is added, via the liquidus bar of the blender, ferrous sulfate and calcium oxalate monohydrate, followed by fumed silicon dioxide powder. The order of addition of the ingredients of the desired mix is not critical, but preferably, the carbonized cotton fibers are initially introduced into the blender, followed by the addition of the calcium oxalate, followed by the addition of the ferrous sulfate, and finally, addition of the low density silica. Preferably, the calcium oxalate monohydrate is suspended in hot methanol and added to the blender via the liquidus bar. Similarly, the ferrous sulfate is suspended in water and also added to the blender via the liquidus bar. The silicon dioxide powder is added in the dry powder form to the blender.

In a preferred mixture, there is employed 31.6 parts of carbonized cotton fibers, 0.4 parts of calcium oxalate monohydrate, 12.5 ml of a solution of 25 mg $Fe^{++}$/ml water (in the form of ferrous sulfate; equivalent of 0.0036 gm Fe) and 68.2 parts of fumed silicon carbide.

The quantity of cotton fibers in the mix may vary between about 25 and about 35 parts; the calcium oxalate may vary between about 0.3 and about 0.6 parts; the ferrous sulfate may vary between about 10 and about 25 ml of the noted suspension; and the silicon oxide may vary between about 66 and about 70 parts. Preferred results are obtained when the mix is mixed to homogeneity. In particular, homogeneity of the dispersion of the ferrous sulfate within the mix is important in ensuring conversion of the fibers to silicon carbide. Further, it is of importance in the present invention that the mix be free of any significant amount of a whisker growth component, such as boric oxide.

Drying of the mixture may be carried out by dispensing the mix from the blender into flat pans, for example, and heating the mixture in the pans within an oven at 300 degrees F.

The dried mix is thereafter loaded into semi-porous graphite closed containers for conversion of the fibers of the mix to silicon carbide. In a preferred embodiment, the mix within a tube is heated as rapidly as possible to a temperature of about 1700 degrees C. In a preferred embodiment, this activity is carried out by preheating an oven to a temperature of 1700 degrees C. and, after expulsion of air from the mix in the tube by means of a brief (e.g. 45 minutes) argon purge, the tube with its mix contents is moved into the preheated oven, having an inert atmosphere, and held therein for between about one and about 5 hours. Preferably, the residence time within the oven is about two hours.

Employing the process of the present invention, there is achieved substantially 100% conversion of the fibrous material to silicon carbide, with a yield of between about 20% and 30% of the original weight of the carbonized cotton fibers. As may be seen from the single FIGURE, the vast majority of the silicon carbide fibers produced are of a size approximating the size of cellulosic paper-making fibers. The remainder of the mix comprises relatively small amounts of silicon carbide particulates and/or shorter silicon carbide fibers. The product so produced contained an insignificant quantity (e.g., less than 1%) of silicon carbide whiskers. Microscopic examination of the product showed silicon carbide fibers having individual diameters of about 5–25 microns in diameter and lengths of between about 100 and about 3,000 microns.

The product produced by the present invention was formed into a sheet employing conventional paper-making techniques. This paper was thereafter pleated employing a conventional pleating machine, preferably which the sheet was captured between first and second cellulosic paper sheets. The pleated sheet was formed into a filter geometry and tested for susceptibility to microwave radiation, employing a conventional household microwave oven of 2.45 GHz (about 600 watts). It was found that the product produced by the present invention consistently was heated in this oven to greater than 700 degrees C. within about 30 seconds.

What is claimed:

1. A method of producing discontinuous silicon carbide fibers comprising the steps of blending together in a quantity of carbonized fibers, a quantity of metal salt which serves as a promoter for the conversion of said carbonized fibers to silicon carbide fibers, a quantity of calcium oxalate, and a quantity of silicon dioxide for a time sufficient to develop a substantially homogeneous admixtue, drying said admixture, in a semiporous graphite container, heating said admixture for a time and at a temperature at which said carbonized fibers in said admixture are converted to silicon carbide fibers.

2. The method of claim 1 wherein said fibers are carbonized cotton fibers.

3. The method of claim 2 wherein said metal salt is ferrous sulfate.

4. The method of claim 1 wherein said silicon dioxide comprises low density silicon dioxide.

5. The method of claim 4 wherein said silicon dioxide comprises fumed silica.

6. The method of claim 1 wherein said components of said admixture comprise between about 25 and about 35 parts carbonized cotton fibers, between about 0.3 and about 0.6 parts calcium oxalate monohydrate, between about 66 and about 70 parts fumed silicon dioxide, and between about 10 and about 25 ml of a solution having a concentration of about 25 mg Fe++/ml of water in the form of ferrous sulfate.

7. The method of claim 1 wherein said admixture is dried with heat at about 300 degrees C.

8. The method of claim 1 wherein said dried admixture is disposed within a semi-porous graphite container, exposed to an inert gas purge for a time sufficient to expel substantially all air from the container and admixture, and said purged container and admixture are introduced into a preheated inert environment at a temperature of between about 1450 and about 1750 degrees C.

9. The method of claim 8 wherein said purged container and admixture are held within said preheated inert environment for a residence time sufficient to effect conversion of said carbonized fibers to silicon carbide fibers.

10. The method of claim 9 wherein said conversion of carbonized fibers is greater than 90 percent, said converted fibers comprising between about 20% and about 30% of the weight of the weight of the non-converted carbonized fibers.

11. The method of claim 10 wherein said residence time of said container and admixture within said preheated environment is between about one and about five hours.

* * * * *